US007980806B1

(12) United States Patent
Conner et al.

(10) Patent No.: US 7,980,806 B1
(45) Date of Patent: Jul. 19, 2011

(54) CONVEYOR ROLLER ASSEMBLY INSTALLING SYSTEM

(75) Inventors: Robert B Conner, Pulaski, VA (US); Tom A Weeks, Beckley, WV (US)

(73) Assignee: Tom A. Weeks, Beckley, WV (US)

( * ) Notice: Subject to any disclaimer, the term of this patent is extended or adjusted under 35 U.S.C. 154(b) by 658 days.

(21) Appl. No.: 11/702,274

(22) Filed: Feb. 5, 2007

Related U.S. Application Data

(60) Provisional application No. 60/765,151, filed on Feb. 3, 2006.

(51) Int. Cl.
*B66F 11/00* (2006.01)

(52) U.S. Cl. ..... 414/589; 414/680

(58) Field of Classification Search ..... 414/409, 414/589, 590, 622, 680, 685, 500, 542, 543; 212/347, 348, 349, 350, 901; 901/1, 16, 901/17

See application file for complete search history.

(56) References Cited

U.S. PATENT DOCUMENTS

| | | | | |
|---|---|---|---|---|
| 857,409 | A * | 6/1907 | Marvin | 414/543 |
| 4,003,479 | A * | 1/1977 | Reyer | 414/471 |
| 4,381,900 | A * | 5/1983 | Schlottman | 414/718 |
| 4,676,713 | A * | 6/1987 | Voelpel | 414/590 |
| 5,570,992 | A * | 11/1996 | Lemelson | 414/744.3 |
| 6,766,996 | B1 * | 7/2004 | Somers | 248/650 |

* cited by examiner

*Primary Examiner* — Donald Underwood
(74) *Attorney, Agent, or Firm* — Dinsmore & Shohl LLP; Monika J. Hussell

(57) ABSTRACT

A vehicle supported mine item positioning apparatus for placing, for example, heavy mining conveyor belt items such as roller assemblies, conveyor frame side rails, frame sections or the like in precise positions for attachment to other conveyor structure, wherein the vehicle can get into cramped quarters in the mine alongside the conveyor and extend, retract, rotate and further manipulate an item pick-up crane mounted on the vehicle, whereby the crane with item pick-up means mounted on an end thereof can pick up and place, e.g., a roller assembly in a precise position and posture on a conveyor frame for making said attachment, and further in a preferred embodiment, the apparatus is provided with second crane means for lifting a moving conveyor belt off of a roller assembly for replacement of said assembly with or without stopping the belt, whereby worker lifting and manipulation of heavy roller assemblies or other heavy mining structures is eliminated.

18 Claims, 18 Drawing Sheets

36A
36B
36I
13

103
97
99
99
105
54
63
59
62

70
66
68
56
76
62
67
71
77
54
74
65
73
72
69
75
79
19
93
95
83
58
60
59
50
48
100
52
81
64
89
81
79
91
85
67
97
105
103
9A
9A
42
106
104
114
115
112
116
102
98
101
61
110
108
9C
9C
106

CONVEYOR ROLLER ASSEMBLY INSTALLING SYSTEM

This application claims benefit of Applicants pending Provisional entitled "MECHANICAL CONVEYOR ROLLER ASSEMBLY INSTALLING SYSTEM" filed Feb. 3, 2006 as No. 60/765,151.

BACKGROUND OF THE INVENTION

1. Field

This invention is directed to an apparatus for lifting and placing heavy items in precise position for installation such as installing heavy mine belt roller assemblies which include, for example three heavy rollers mounted on a steel frame, as repair or for belt extensions or the like in underground tunnel mining operations.

In the field of underground mining, most mines transport material from the mining faces to the outside of the mine by means of belt conveyors. Even in shaft mines, conveyor belts usually transport the material to the shaft skips. As an example of one typical situation, as mining progresses, conveyor beltlines must be extended by installing conveyor belt, top run and return run idler rollers, and support structure therefor. In the higher production mines which have wider belts, larger and much heavier roller assemblies and frame structure are required to support the conveyor belts.

2. Prior Art

Heretofore, installing the roller assemblies, for example, has been very difficult for the workers, to the point of being a chronic safety issue. A single top roller assembly can weigh over 300 lbs. requiring four or more workers to lift and manipulate the assembly in precise mounting position on supporting rails of a conveyor. Medium size idler assemblies weighing 100 lbs. or so each are still a safety issue. A single back injury can cost a mining company over $500,000.

Installing the larger belt components is also a production efficiency issue. Work accomplished per hour in making an installation is slow, and considerable production can be lost due to the extended time required to make, for example, a belt advancement (extension). Needed for years has been a good mechanical means to lift, manipulate and precisely position the larger roller assemblies and frame structure to reduce difficulty, number of workers, man hours, injuries, and downtime encountered in the installation. Further, in the case of coal mining, which is the largest segment of underground mining in general, the tunnel width is limited, by law, to 20 feet. The belt lines are usually installed with the edge of the belt line on the center line of the shaft entry leaving a maximum of about 10 feet lateral space in which to accomplish a mechanical installation of roller assemblies or other structure. Also involved in developing a viable mechanical alternative to the human back is the limited vertical room to the mine roof such that large equipment may not fit into the shaft.

SUMMARY OF THE INVENTION

A vehicle supported lifting system for placing, for example, heavy mining conveyor belt items such as roller assemblies, conveyor frame side rails, frame sections or the like in precise positions for attachment to other conveyor structure, wherein the vehicle can get into cramped quarters in the mine alongside the conveyor and extend, retract, rotate and further manipulate an item pick-up crane mounted on the vehicle, whereby the crane with item pick-up means mounted on an end thereof can pick up and place, e.g., a roller assembly in a precise position and posture on a conveyor frame for making said attachment, and further in a preferred embodiment, the apparatus is provided with second crane means for lifting a moving conveyor belt off of a roller assembly for replacement of said assembly with or without stopping the belt, whereby worker lifting and manipulation of heavy roller assemblies or other heavy mining structures is eliminated.

As used herein:

Conveyor belt: is the conveyor belting itself;

Top Roller Assembly: this is the frame and one horizontal and two side angle rollers built into a roller assembly that supports the conveyor belt top run;

Return Roller Assembly: is usually one single roller that supports the return side (bottom run) of the conveyor belt;

Support Structure: are the stands and rail system that the roller assemblies are mounted on and fastened to. The support structure can stand on the mine floor or can be suspended from the mine roof.

The present system is designed primarily to remove or install the top roller assemblies since they are the heaviest and most difficult items to handle and affix. The conventionally used top roller assemblies are not required to be changed or modified to accept the mechanical means of the present invention in order to allow precise positioning and maintenance of the roller assemblies on the conveyor frame while affixing them thereto.

BRIEF DESCRIPTION OF THE DRAWINGS

The invention will become understood further from the drawings and description thereof, wherein.

DETAILED DESCRIPTION

Figure 1:
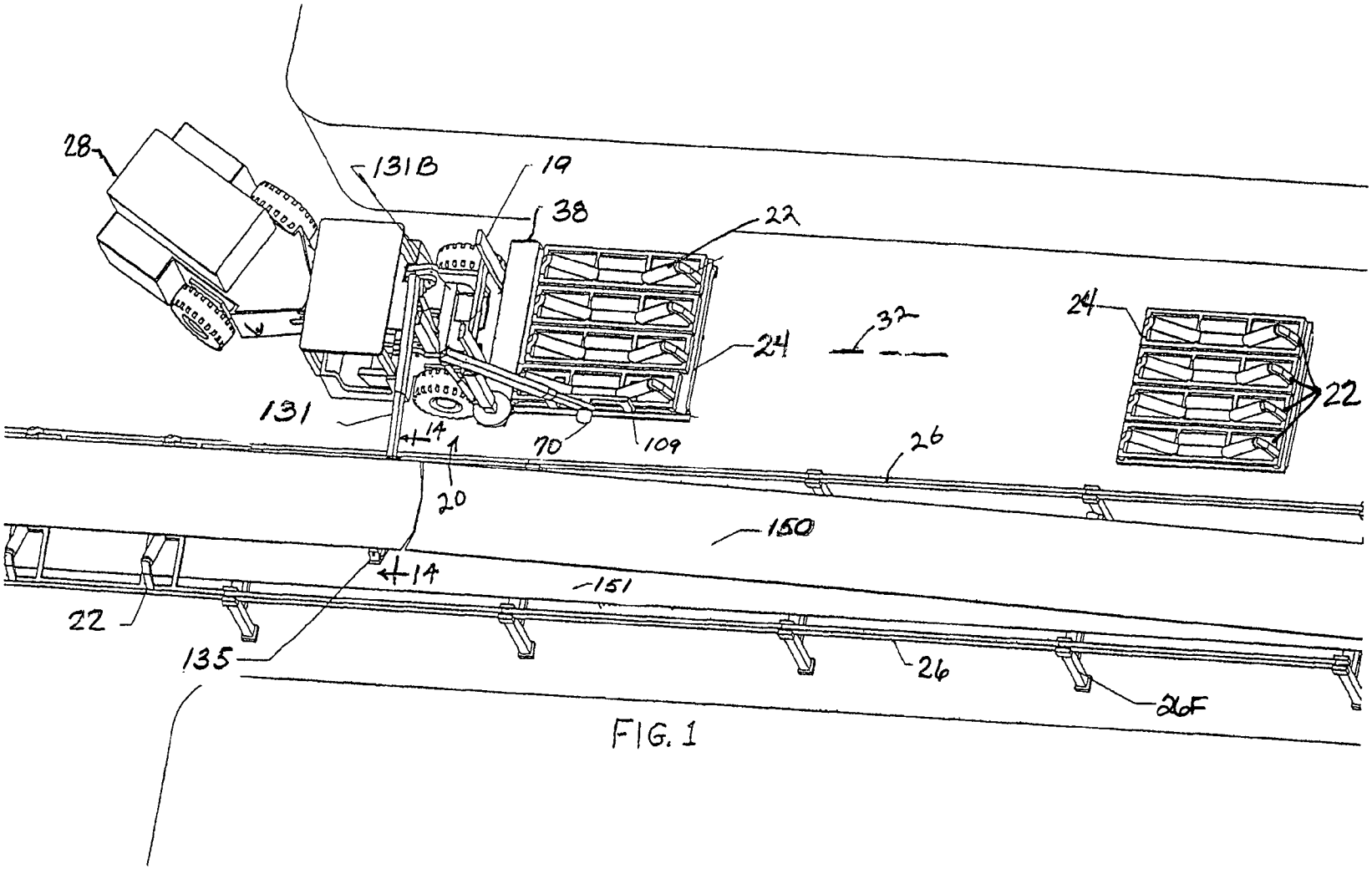
FIG. 1 is a top down perspective view of the present positioning apparatus in a mine shaft or mine tunnel in the process of picking up a conveyor belt roller assembly from a fork lift pallet.

The present invention will be understood further with reference to the drawings and to the claims herein wherein the invention comprises an apparatus generally designated 20 for picking up heavy structural items such as individual roller assemblies 22, pallets 24 loaded with such assemblies, conveyor railing 26 and/or floor stands therefor 26F, roof supports, air stoppings and the like, particularly as used in coal mines or other mines, especially where the items are to be manipulated into confined spaces for assembly, and then placing the items in precise positions for assembly onto structures located in said confined quarters.

The lifting is done by a crane generally designated 19 which is mounted on a base means generally designated 34 of the apparatus, which base means is adapted for attachment to a vehicle such as an articulated power mine tractor 28, a mine supply vehicle, trailer 30, fork lift truck, farm tractor, skid steer or the like, including a non-wheeled skid, all having a transport axis 32. A hydraulic power system 29 is preferably provided on the vehicle or the base means. The base means 34 has a first base section 36 adapted for attachment (by mounting plate 36A or other similar structure), either permanent or removable, to said vehicle at, for example, a face plate 36B thereof. The base means 34 further has a second base section 38 mounted on said first section 36 for movement with respect thereto in a generally horizontal first plane 40. A first power means 42 is provided for controllably moving said second section 38 relative to said first section 36 in said first plane 40. A third base section 43 is mounted on said second section 38 for movement with respect thereto in a generally horizontal second plane 44 by second power mans 46. By means of these three base sections, a greater lateral reach can be achieved by the positioning of the second and third sections without requiring a berth greater than the width of the vehicle. For example, double sliding bases with a 60 inch frame can provide an 84 inch total slide.

A first stanchion means 48 is pivotally mounted on a generally vertical axis 50 on said third section 43 for movement with said third section in said second generally horizontal plane 44, and third power means 52 is provided for pivoting said first stanchion means about said substantially vertical axis 50. A lifting boom 54 having a longitudinal axis 56 has an inner end portion 58 pivotally mounted on an upper end portion 60 of said first stanchion means for pivoting of said boom in a generally vertical plane 62. A fourth power means 64 is provided for controllably pivoting said boom in said generally vertical plane 62.

A structural item gripping means generally designated 66 is mounted on an outer end 68 of said boom by fifth power means generally designated 70 for pivoting said gripping means into a desired posture relative to said boom, and wherein said boom is constructed with extendable-retractable boom sections of any number such as 2-6, but preferably three such as 72, 74, 76 for elongating or shortening said boom respectively, and wherein sixth power means is provided for extending and retracting said sections.

Referring further to base mans 34 and FIGS. 8, 8*a*, 8*b* and 9*b*, this base structure is preferably constructed of heavy steel components, e.g., ½-¾ in. thick steel sections welded together to form a plurality of I-beam frames 36I and 38I, as depicted in monolithic form as in the figures. The second base section 38 is provided with longitudinally extending slide bars 80 of low friction, readily slidable, tough plastic material such as poly tetra fluoroethylene (Teflon), polyoxymethylene (Delrin), high density polyurethane or the like which can resist the wear of long term sliding in channels 82 of the first base section. These bars are held in place in the channels preferably by steel strips 84 having bolts 86 spaced longitudinally therealong and welded thereto. In assembling these bars on section 38, strips 84 are slid longitudinally into slots 88 to where the ends of the strips and bars substantially coincide. The bolts, affixed to strips 84, are then inserted thru holes which were predrilled thru 38 at the same longitudinal spacing as the bolts. Nuts 92 are then tightened to securely and immovably fasten the bars to 38.

Figures 9, 9A:
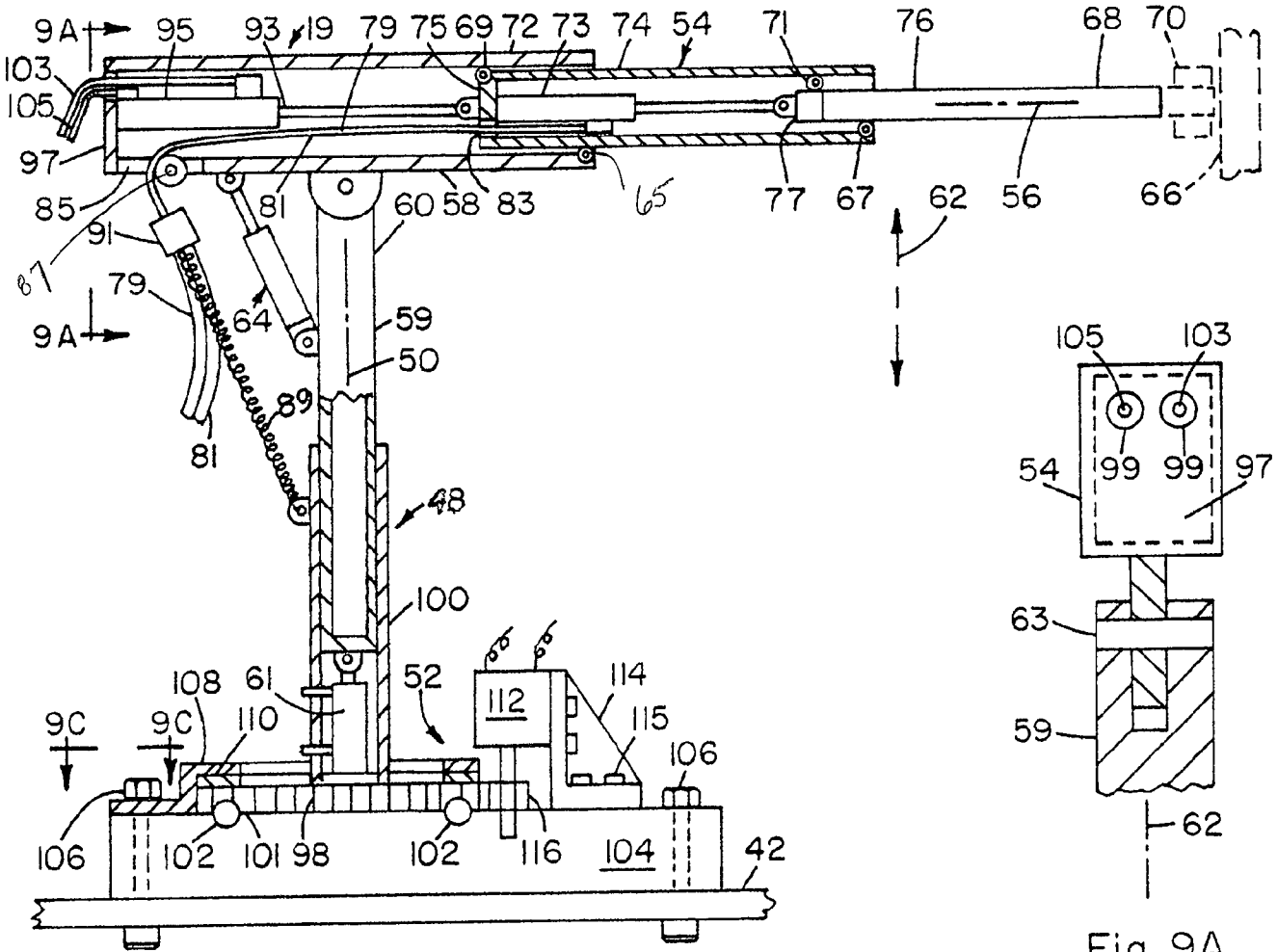
FIG. 9 is a partially cross-sectioned view of one working embodiment of the present primary crane with first stanchion means and lifting boom.
FIG. 9A is a view of elements of embodiments of the present invention, taken along the reference lines 9A-9A in FIG. 9.
Figure 9C:
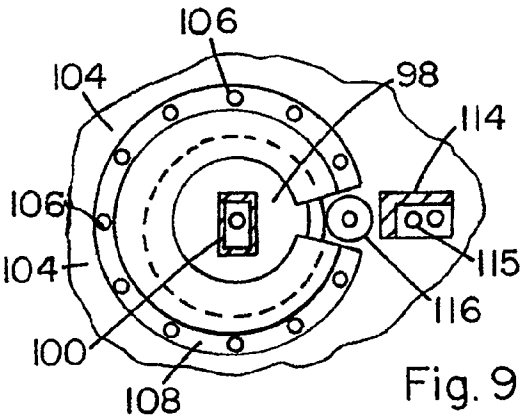
FIG. 9C is a view of elements of embodiments of the present invention, taken along the reference lines 9C-9C in FIG. 9.
Figure 9D:
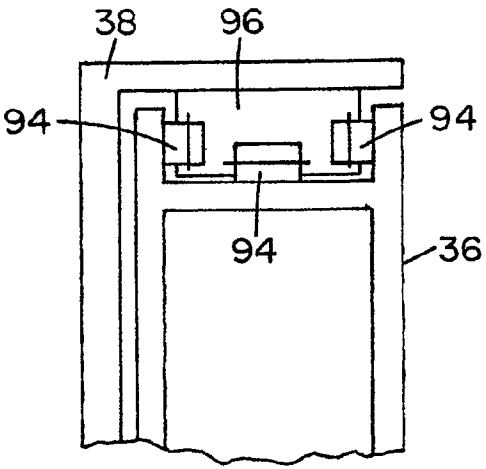
FIG. 9D is a view of alternative embodiments of the first and second sections of the present invention.
Figure 9B:
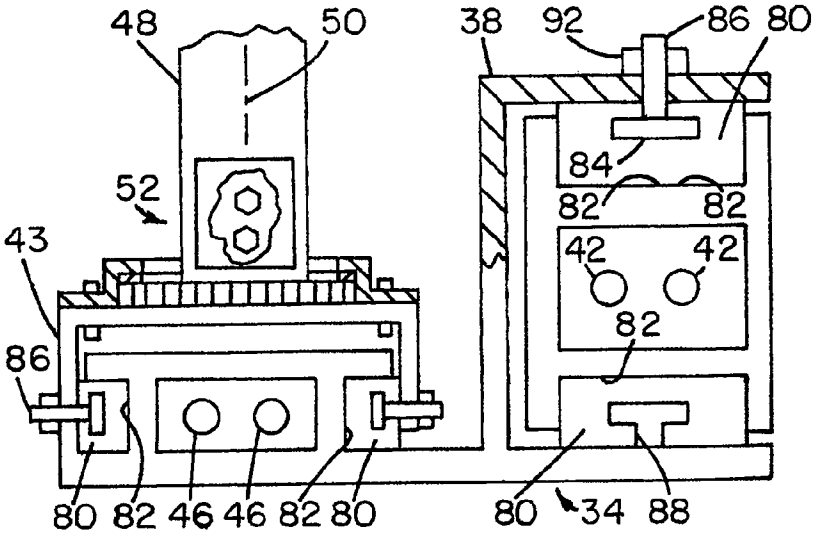
FIG. 9B is a view of elements of embodiments of the present invention.

As a variation, strips 84 with the bolts welded thereto can be mounted within the bars at the same position as shown by casting the plastic around the strips rather than employing slots 88. Also, as shown in FIG. 9D roller bearings (or CAM Followers) such as 94 or the equivalent mounted on supports 96 which is welded in strategically longitudinally spaced positions on section 38 can be used to rollably support section 38 on section 36, both upper and lower portions thereof. Conversely, such rollers can be mounted on section 36 rather than section 38 by bearing means known to the art.

The above described bars 80 and their mountings are also preferably employed for the third base section 43 and the equivalent structures are numbered the same. The above described roller bearing variation is also applicable for the third base section.

Figure 7:
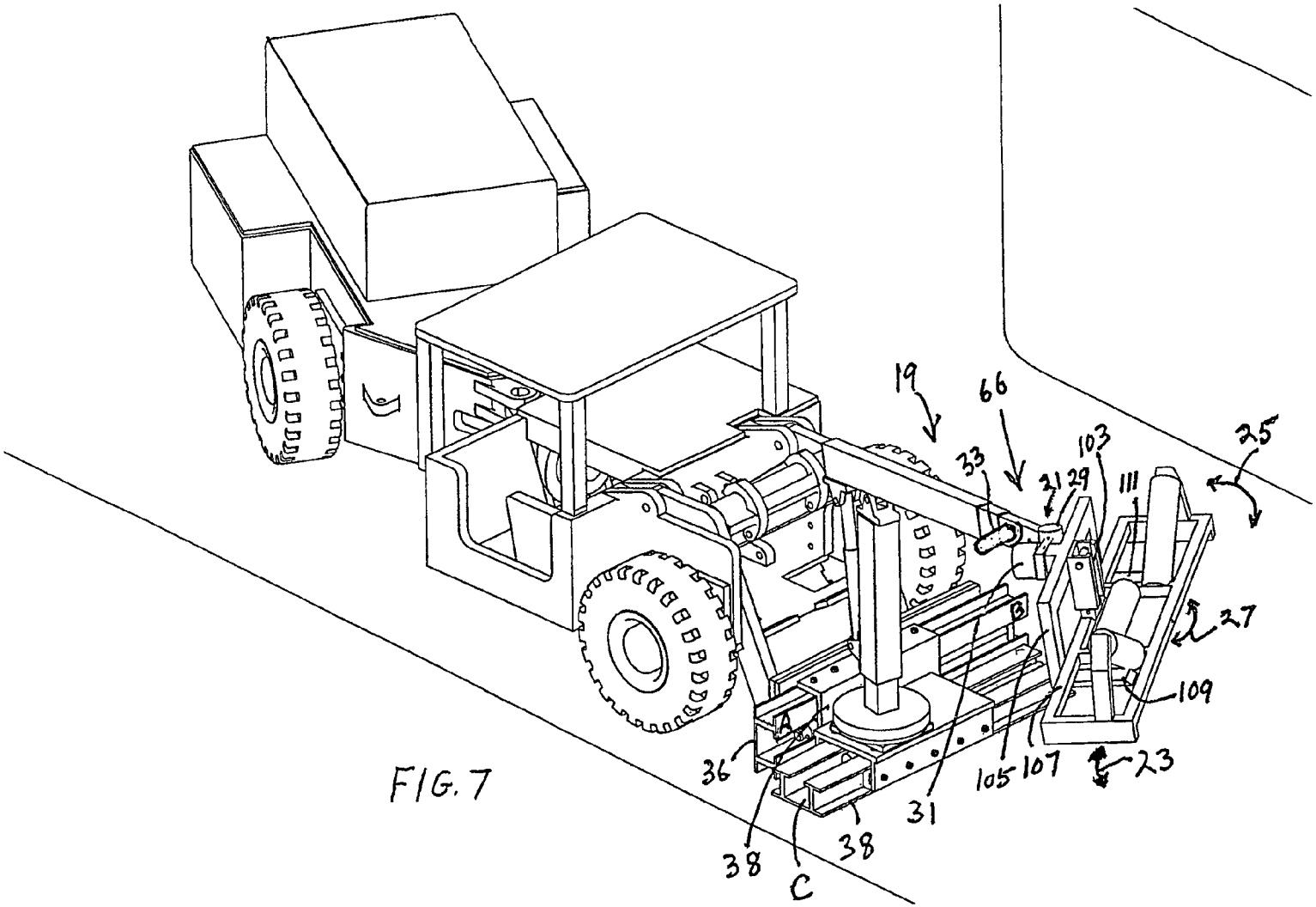
FIG. 7 is an enlarged view of an embodiment of the present apparatus showing a preferred clamping device for holding a roller assembly precisely and securely on the present apparatus.
Figure 8:
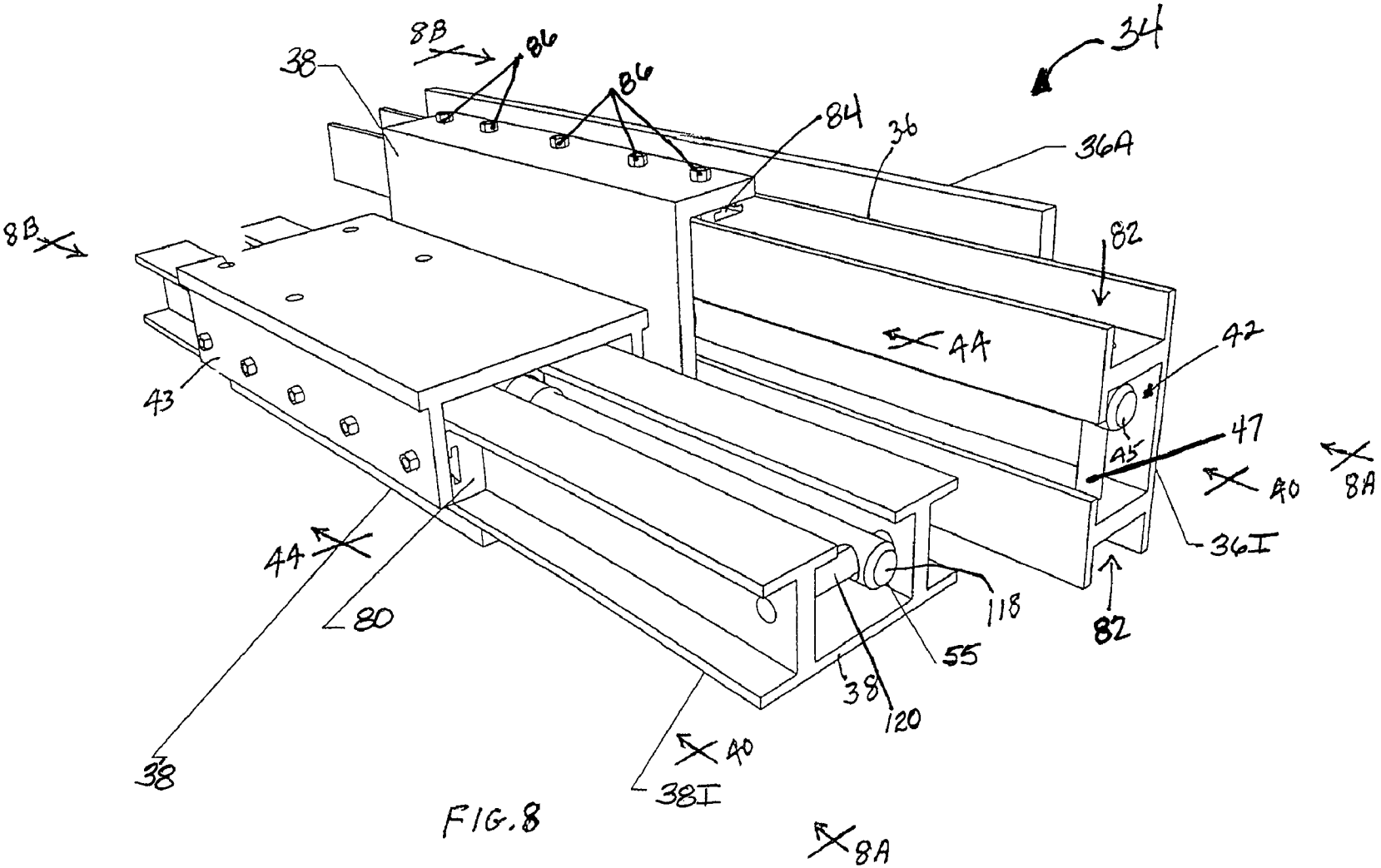
FIG. 8 is a perspective view of a preferred base structure for the present apparatus.
Figures 8A, 8B:
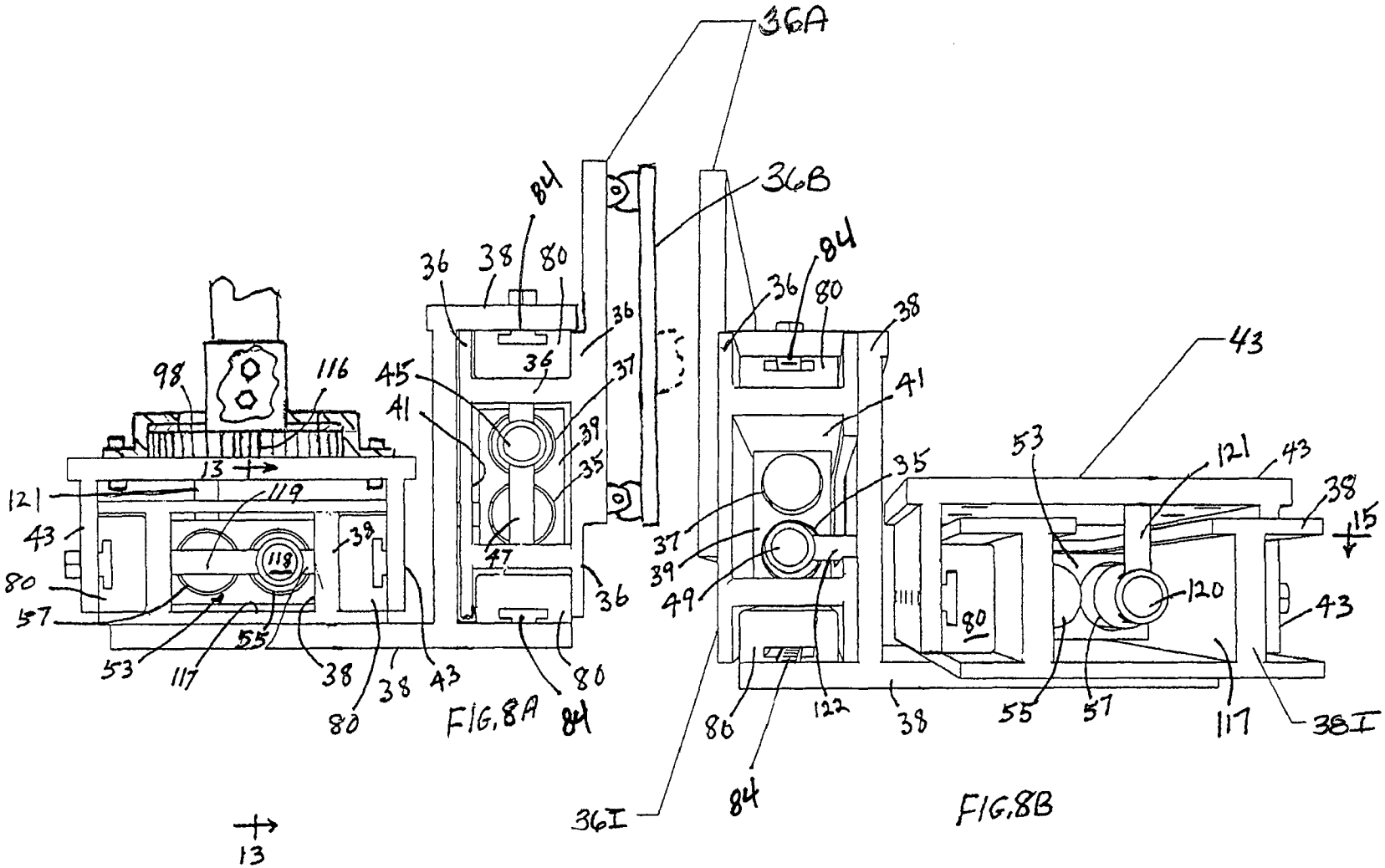
FIG. 8A is an end view taken along line 8A-8A in FIG. 8.
FIG. 8B is an end view, slightly in perspective, taken along line 8B-8B in FIG. 8.

Referring to FIGS. 8, 8A and 8B, the opposed hydraulic cylinders 35, 37 for powering the sliding motion of section 38 on section 36 are fixed relative to each other in a housing 39 which is longitudinally movable and free floating within a channel 41 of section 36. Piston 45 is fixed at its end to section 36 by pin 47 and piston 49 is fixed at its end to section 38 by pin 122. With this structure, simultaneous extension of both pistons 45, 49 will move section 38 longitudinally along section 36 toward position A on 36, and simultaneous retraction of these pistons will move section 38 toward piston B on 36 (FIG. 7).

In similar manner the opposed hydraulic cylinders 55, 57 for powering the sliding motion of section 43 on section 38 are fixed relative to each other in a housing 53 which is longitudinally movable and free floating within a channel 117 of section 38. Piston 118 is fixed at its end to section 38 by pin 119 and piston 120 is fixed at its end to section 43 by pin 121. With this structure, simultaneous extension of both pistons 118, 120 will move section 43 (and crane 19) longitudinally along section 38 toward position C on 38 (FIG. 7), and simultaneous retraction of these pistons will move section 43 (and crane 19) toward position D on 38. All of the above pistons are double acting.

Figure 12:
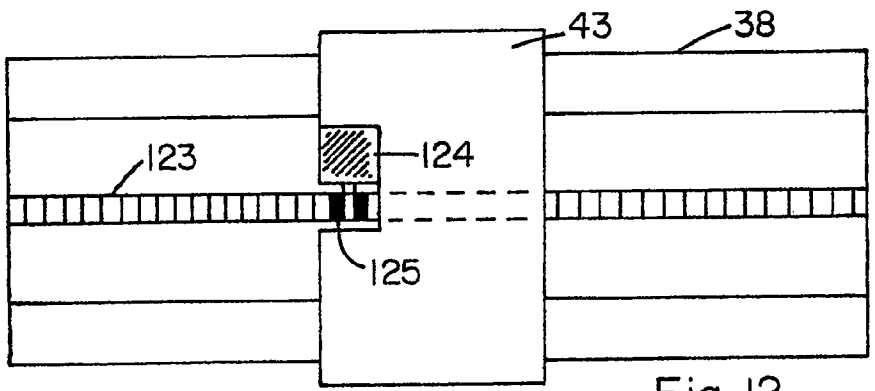
FIG. 12 is a top view of a variation of the power means for moving section 43 on section 38.

Two useful alternative power means for moving section 38 on section 36 and for moving section 43 on section 38 are shown in FIG. 12 for sections 38 and 43 as an example. In FIG. 12 a gear rack 123 of a rack and pinion set is longitudinally affixed to section 38 and an electric or hydraulic motor 124 is mounted on 43 such that its drive gear 125 meshes with rack 123. Section 43 is slidably mounted on 38 in the manner shown for example in either of FIG. 8A or 9D.

Figure 13:
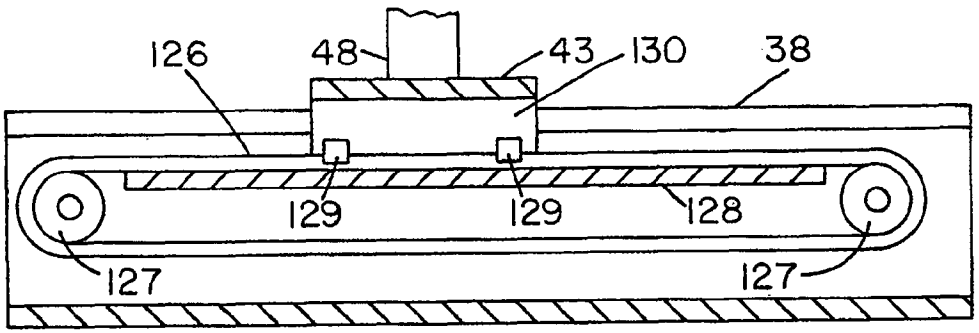
FIG. 13 is a longitudinal cross-section taken along line 13-13 in FIG. 8A showing another variation of the power means for moving section 43 on section 38.
Figure 15:
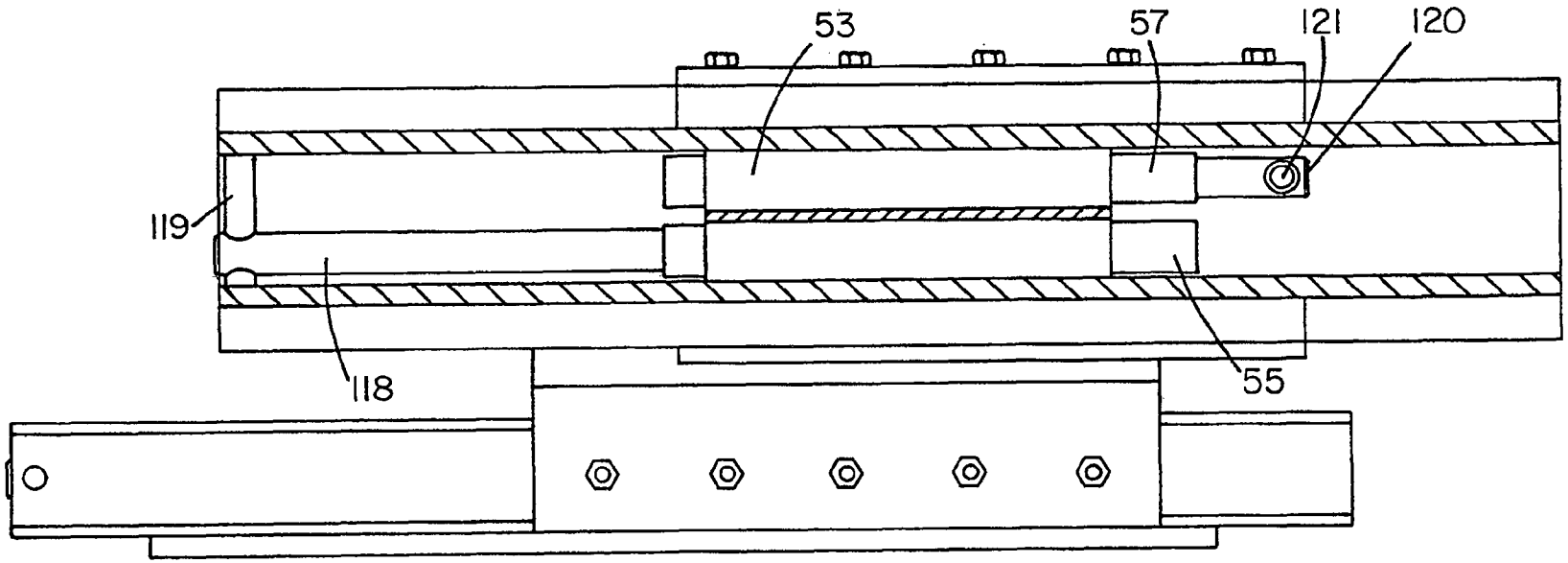
FIG. 15 is a top down view taken along line 15-15 in FIG. 8B showing the back to back dual cylinder mounting.

In FIG. 13 the power means comprises a roller chain or V-belt or the like 126 fixed as by link means 129 to a depending bracket 130 of base section 43, and mounted on sprockets or pulley wheels 127 respectively, either or both of which sprockets or pulley wheels is driven by, e.g., hydraulic or electric motors. For the chain or belt a supporting slide plate such as 128 affixed to 38 is preferably provided.

Referring further to FIGS. 9, 9A, 9B and 9C, a mounting structure and rotative power means for the first stanchion means 48 is shown as a main gear 98 welded to the bottom of a lower section 100 of the stanchion wherein the outer portion 101 of the bottom of 98 is circularly grooved to accommodate a ring of ball bearings 102 which also rest in an adjacent circular groove in a stanchion base 104. The base 104 is bolted as at 106 to third base section 42 for sliding movement therewith. It is noted that section 42 can be used as the stanchion base 104. A hold down rim 108 and a brass or the like ring shaped wear bushing 110 slidingly engages the upper surface of gear 98 and holds stanchion 48 in its upright posture. An electric motor 112 or equivalent is mounted on bracket 114 bolted as at 115 to stanchion base 104 and its output shaft carries a drive gear 116 engaged with gear 98 for rotating stanchion 48 in response to operator signal.

Stanchion 48 preferably is formed of two sections, lower 100 and upper 59. A hydraulic cylinder 61, single or double acting, is affixed to stanchion 48 or to gear 98 and to upper section 59 for adjusting the vertical position of boom 54. The upper section 59 is pivotally mounted by pin 63 to the boom, and a hydraulic cylinder 64 is pivotally affixed to section 59 and the boom for controllably pivoting the boom in plane 62.

In the example shown, boom 54 is formed by any number of mutually slidable sections and three sections 72, 74 and 76 are preferred. These sections may be provided with internal rollers 65, 67 mounted for rotation on the outer ends of sections 72 and 74, respectively and with external rollers 69, 71 mounted for rotation on the inner ends of section 74 and 76 respectively. Double acting hydraulic cylinder 73 is affixed to inner end cap 75 of section 74 and to inner end cap 77 of section 76 for controllably extending and retracting section 76. The hydraulic lines 79, 81 extend rearwardly thru opening 83 in cap 75 and exit thru bottom opening 85 over roller 87 rotatably mounted on section 72. A tension spring 89 is affixed by clamp 91 or equivalent to lines 79, 81 in order to maintain sufficient tension on these lines to prevent kinking thereof as the piston 93 of hydraulic cylinder 95 is retracted. This piston is affixed to cap 75 and double acting cylinder 95 is affixed to end cap 97 of section 72. The hydraulic lines 103, 105 for cylinder 95 exit thru openings 99 in cap 97. Manually operable lever operated control valves for all of the hydraulics is provided in conventional manner.

The item contact portions of the gripping means 66 can take a variety of configurations depending on the shape of the item, and a highly preferred configuration for gripping a typical belt roller assembly is shown in FIGS. 7, 10, 10A and 10B wherein a fork lift type gripping means is shown. A hydraulic cylinder 103 or heavy duty solenoid is mounted on the top frame portion 105 and with a sliding clamp 103A serves to clamp the roller assembly frame 107 against the forks 109, 111.

Figure 10:
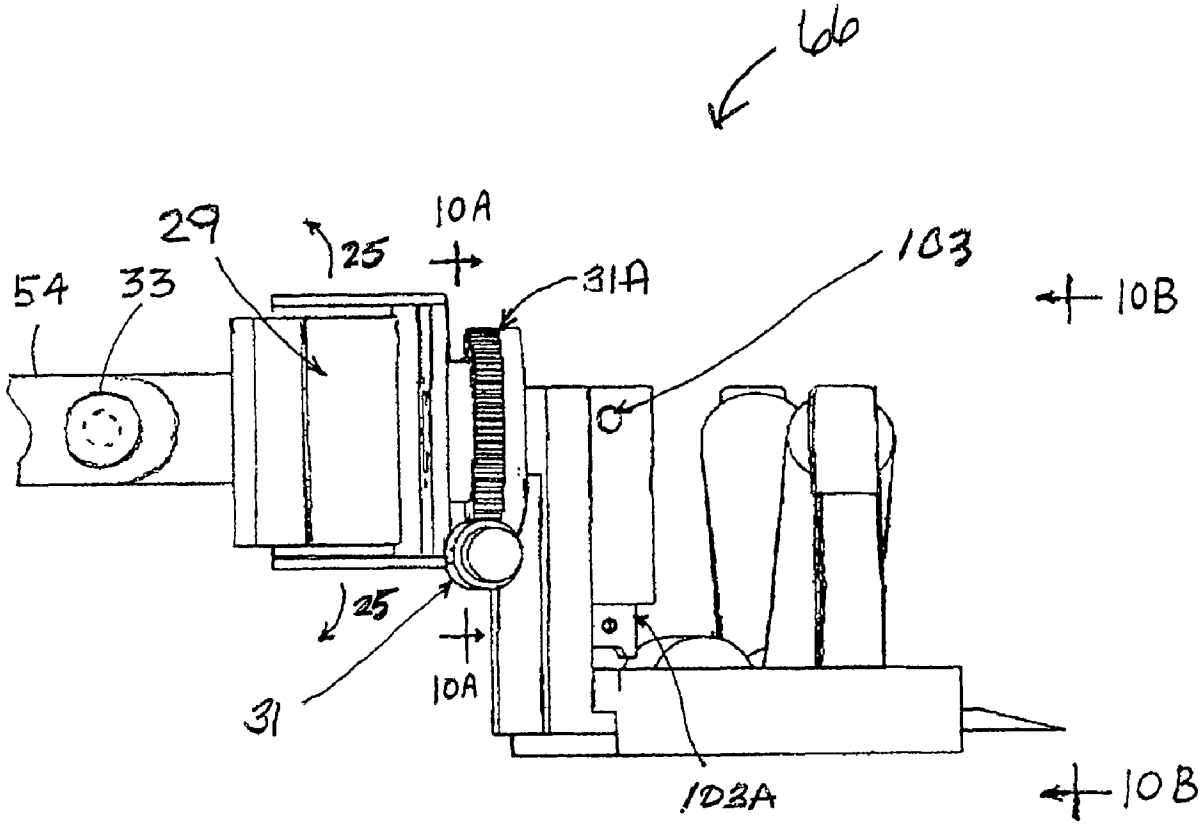
FIG. 10 is a side view of an embodiment of a universal motion power system for the item gripping means.
Figure 10A:
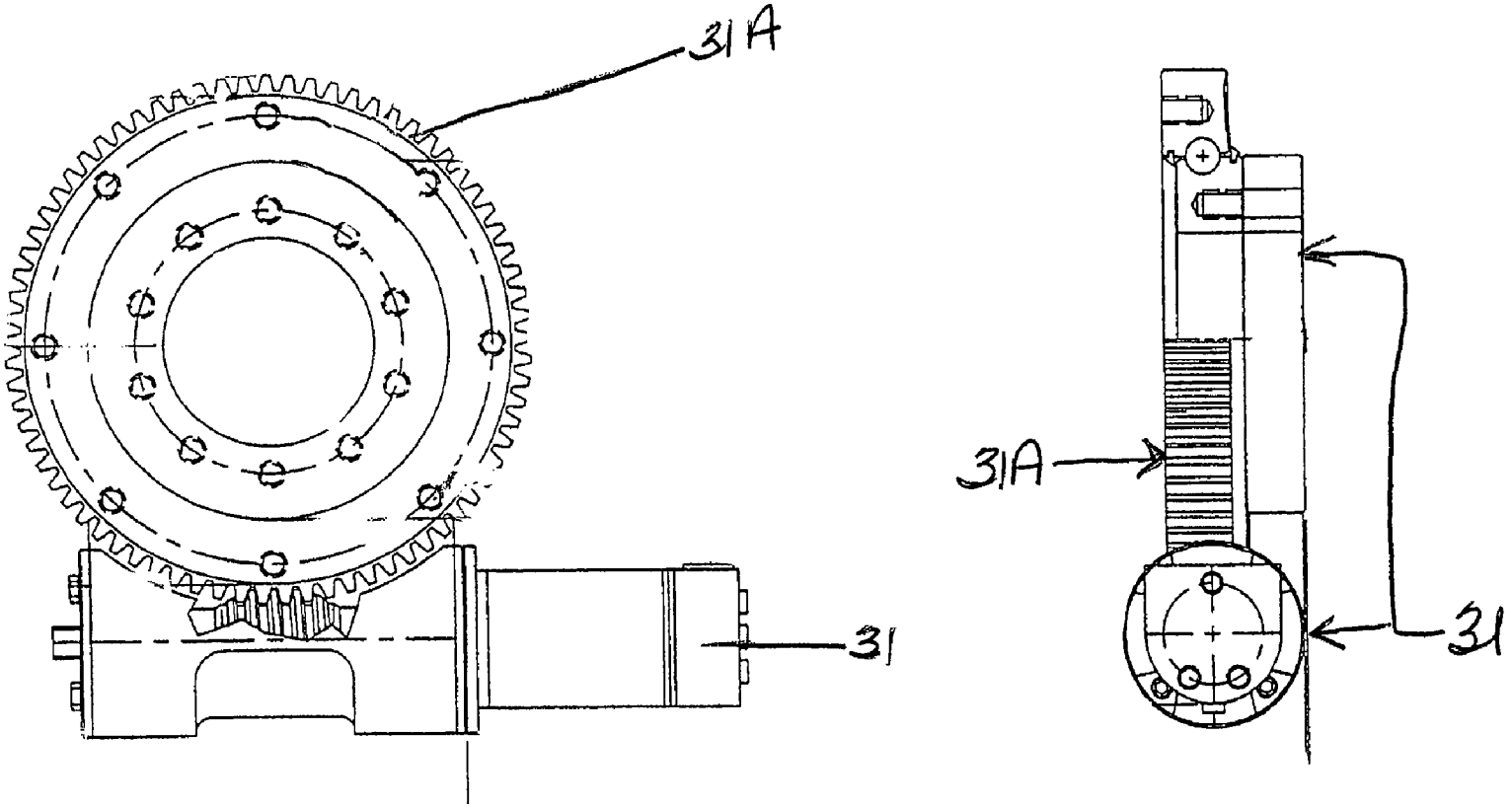
FIG. 10A is a partially sectioned view taken along line 10A-10A in FIG. 10.
Figure 10B:
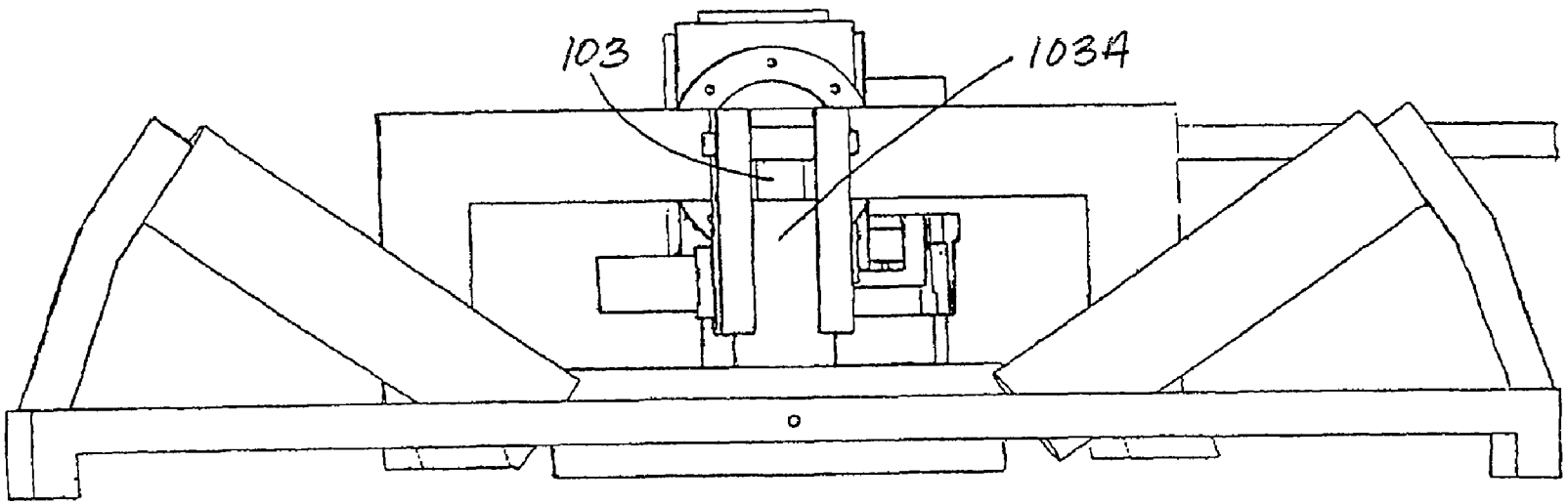
FIG. 10B is a view taken along line 10B-10B in FIG. 10.
Figure 11:
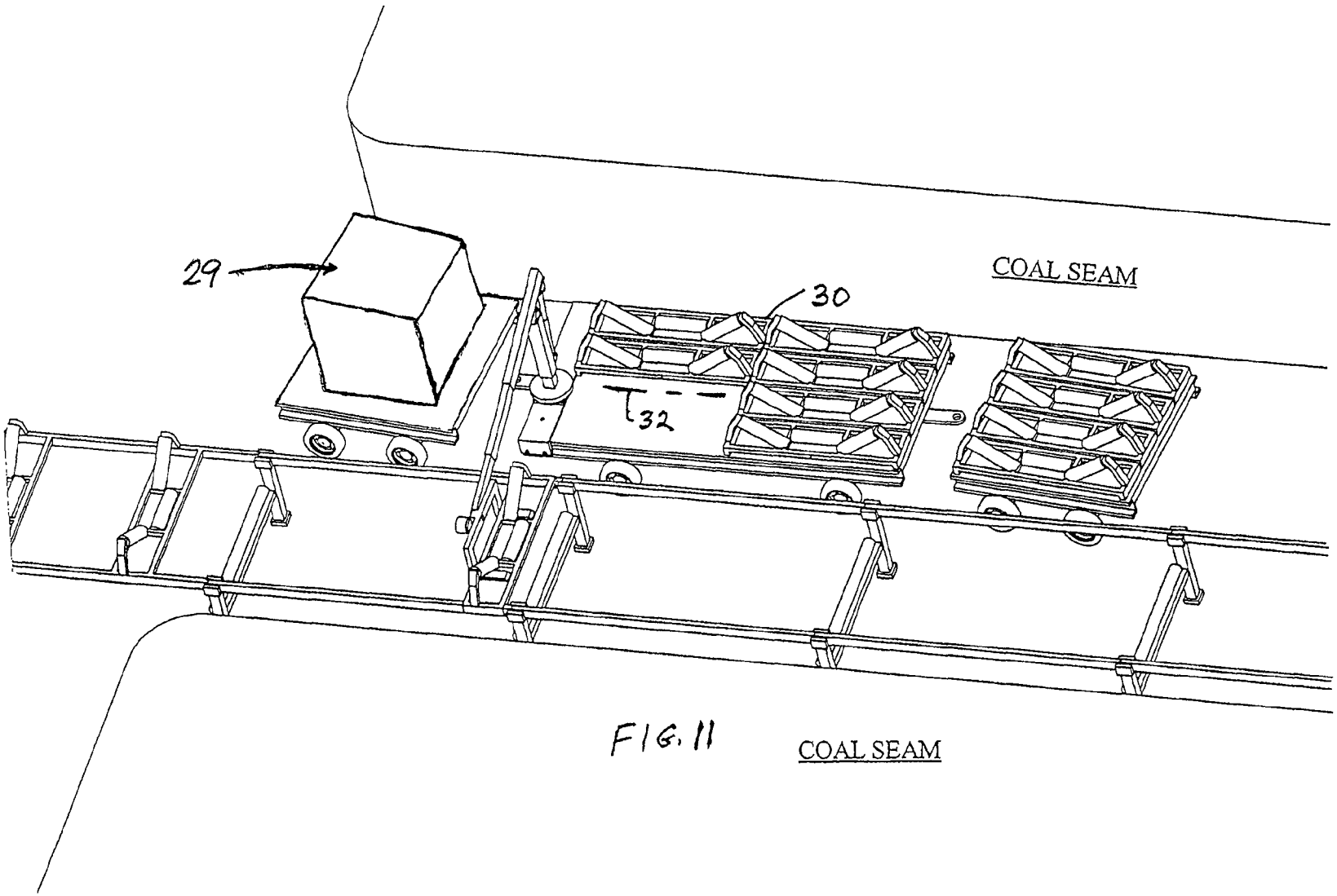
FIG. 11 shows the present apparatus mounted on a pallet trailer wherein the hydraulic power source is mounted on a connected or separate trailer.

A part of the gripping means 66 is the articulating devices therefor, generally designated 21. These devices, preferably, with reference to the roller assembly and to FIG. 7 give universal articulation in endwise up and down rotation 23, in sideways rotation 25, and in up and down tilt 27. These devices can be electrical motor-gear type, hydraulic cylinder type, but preferably a hybrid (combination) of rotary hydraulic actuators 29 and 33, and electrical motor-gear types 31. A typical rotary hydraulic actuator useful in the present invention is disclosed in U.S. Pat. No. 5,447,095 the disclosure of which is hereby incorporated herein by reference in its entirety. In FIGS. 7 and 10, actuator 33 tilts the forks as 27, actuator 29 rotates the forks sideways as 25, and electrical motor-gear 31 (by means of a tilt rotator ring gear 31A) rotates the forks as 23. For certain uses all three power devices may not be necessary, in which case whichever motion is not needed, its associated device can be eliminated.

Figure 2:
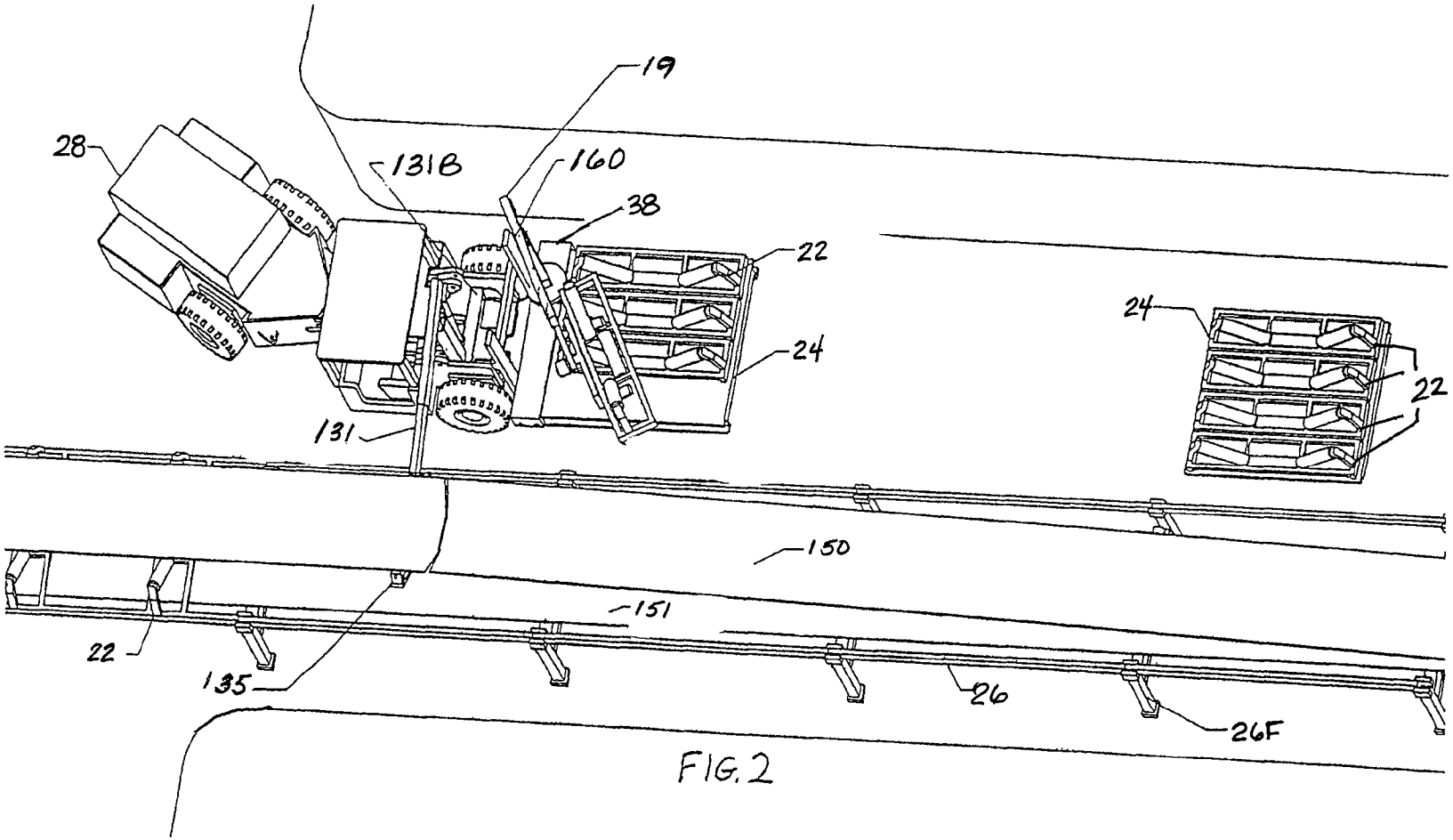
FIGS. 2-4 are subsequent progressions of FIG. 1 of the process of placing a roller assembly in precise position on a conveyor frame by use of the present apparatus.
Figure 3:
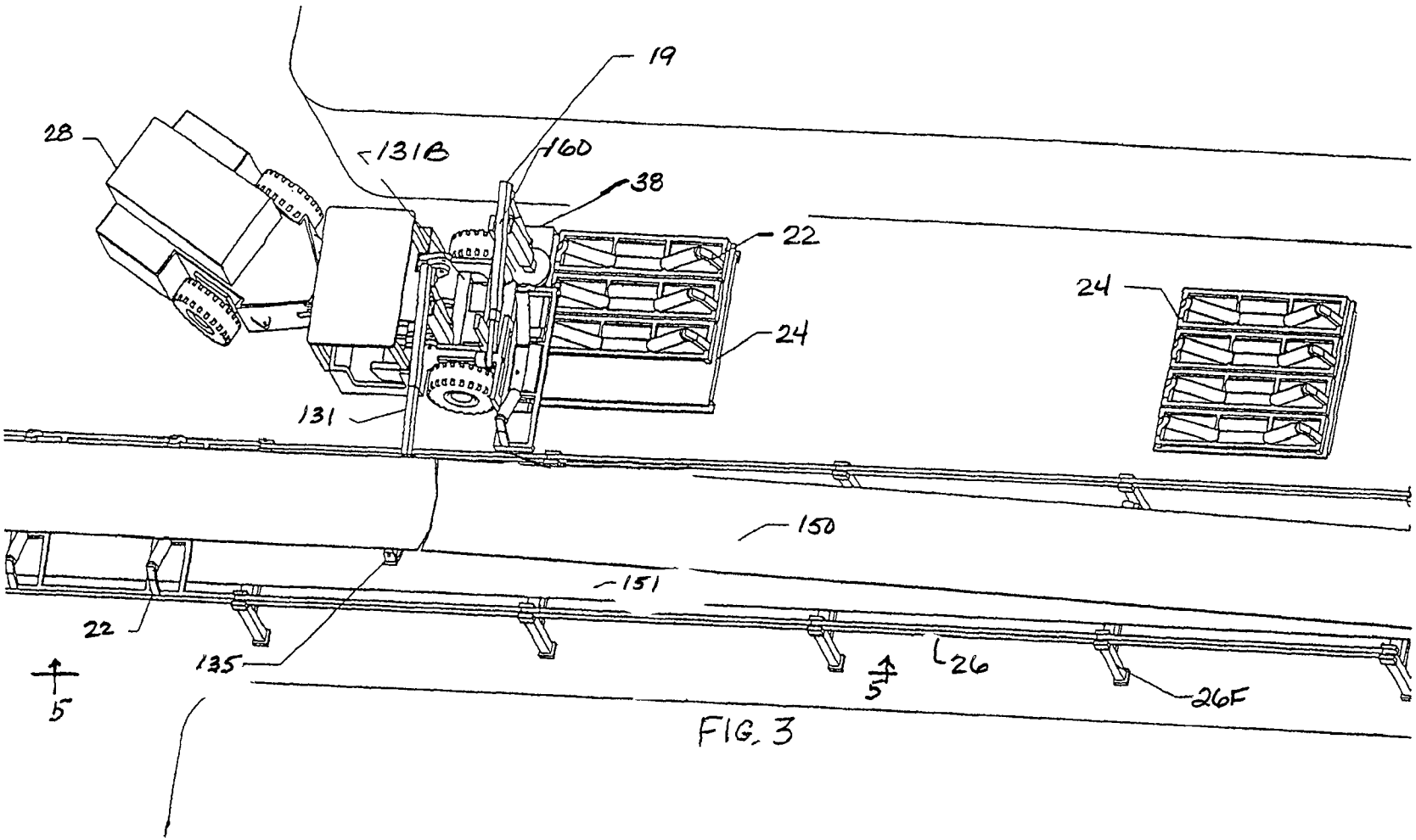
Figure 4:
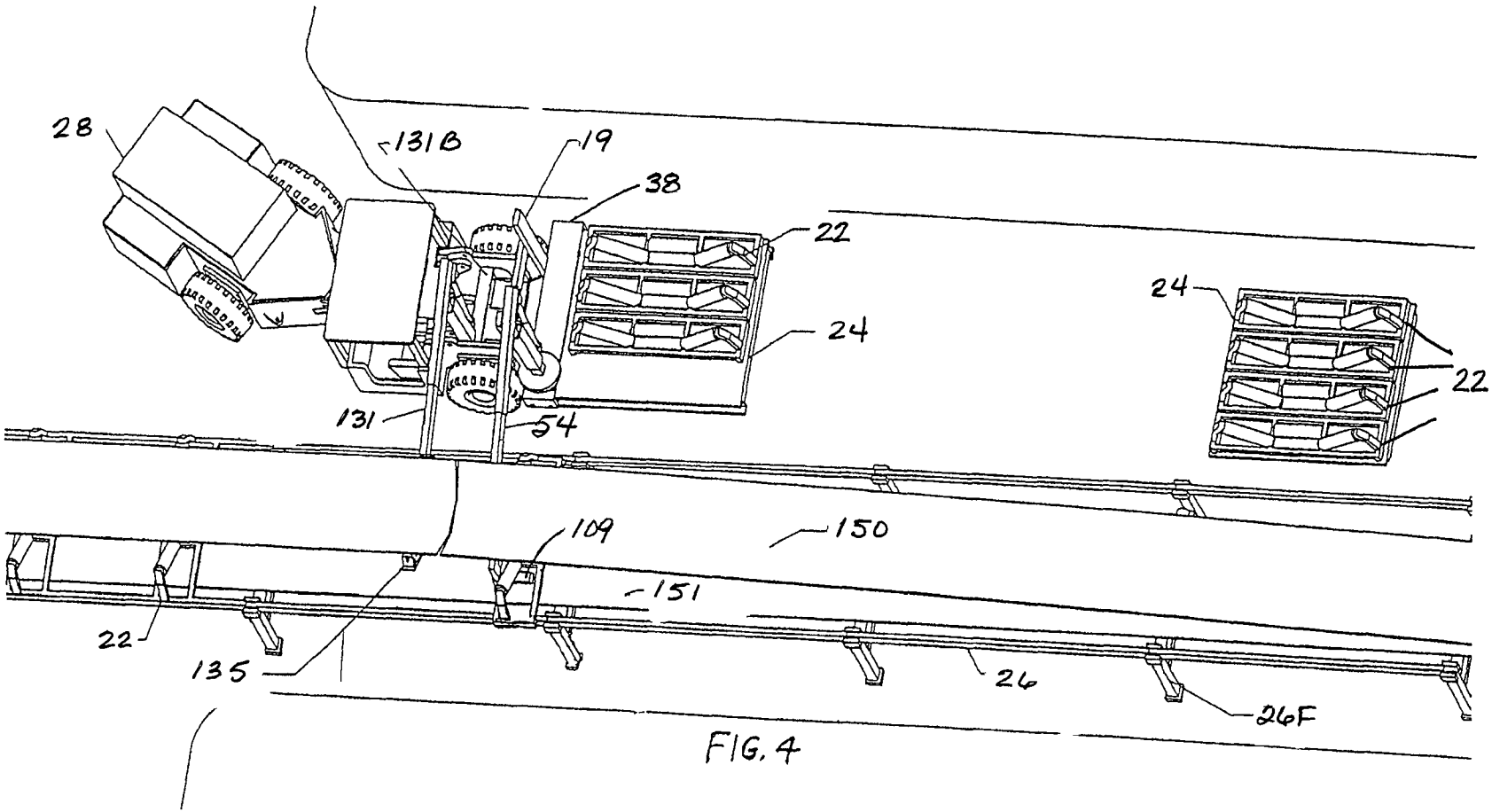
Figure 5:
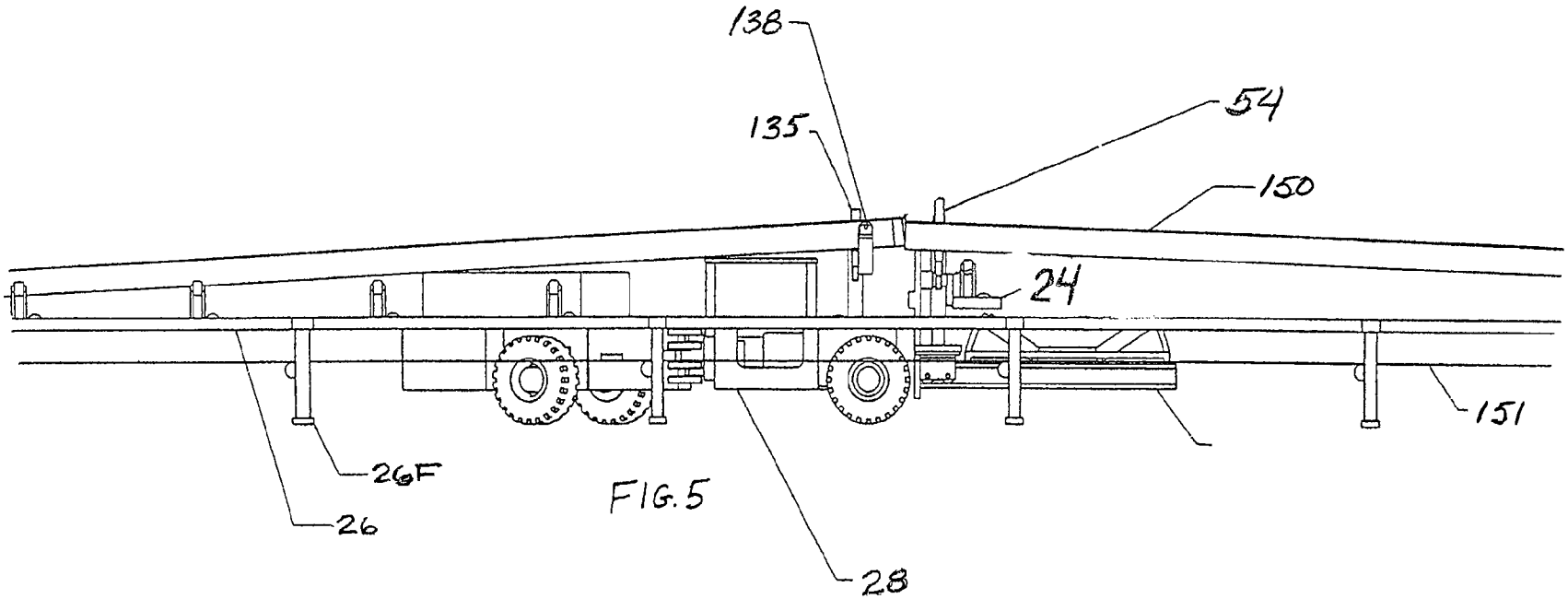
FIG. 5 is a side view of FIG. 1 taken along line 5-5 in FIG. 3.
Figure 6:
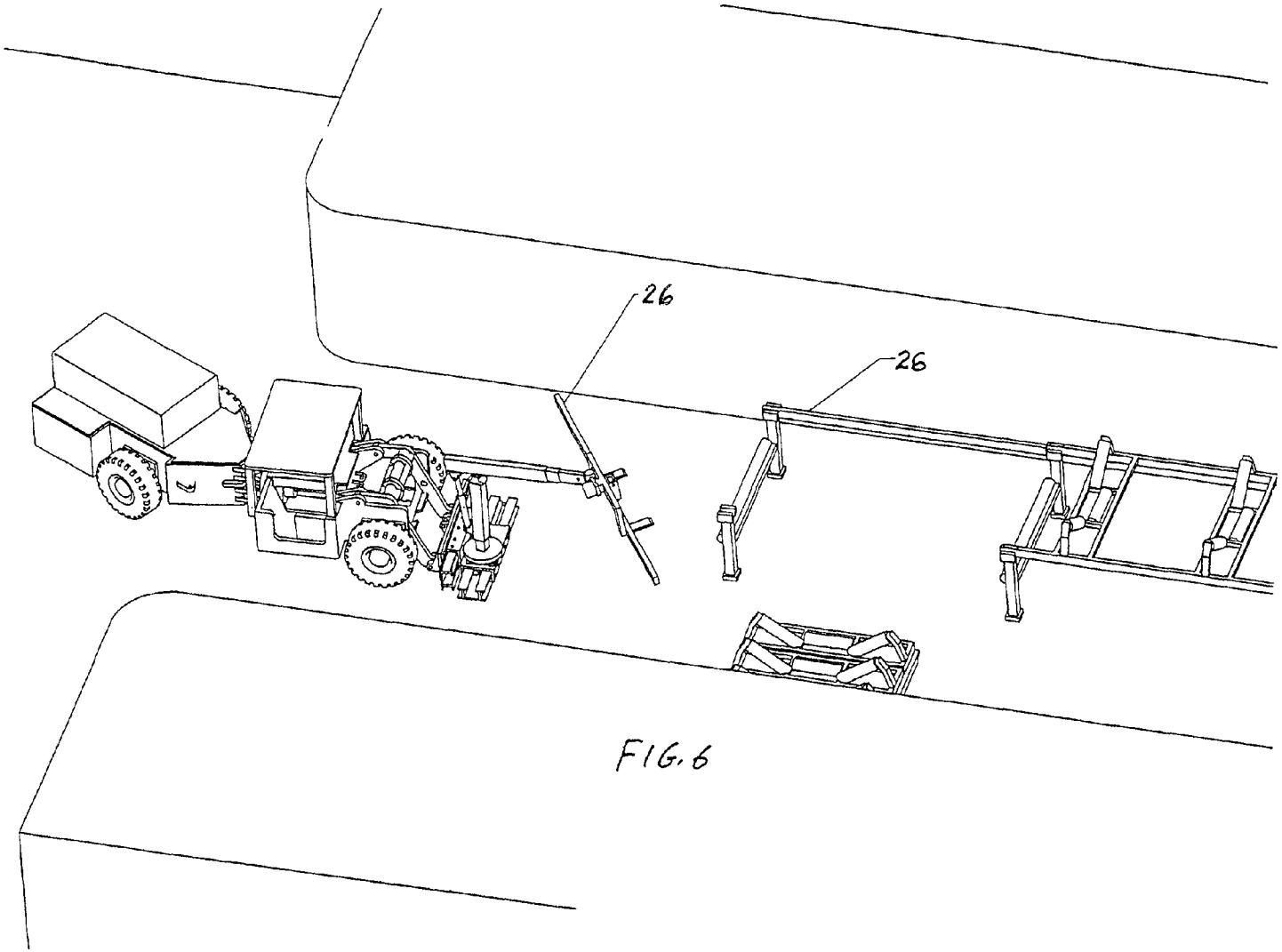
FIG. 6 is a perspective view showing the present apparatus placing a conveyor rail section in position for installation.
Figure 14:
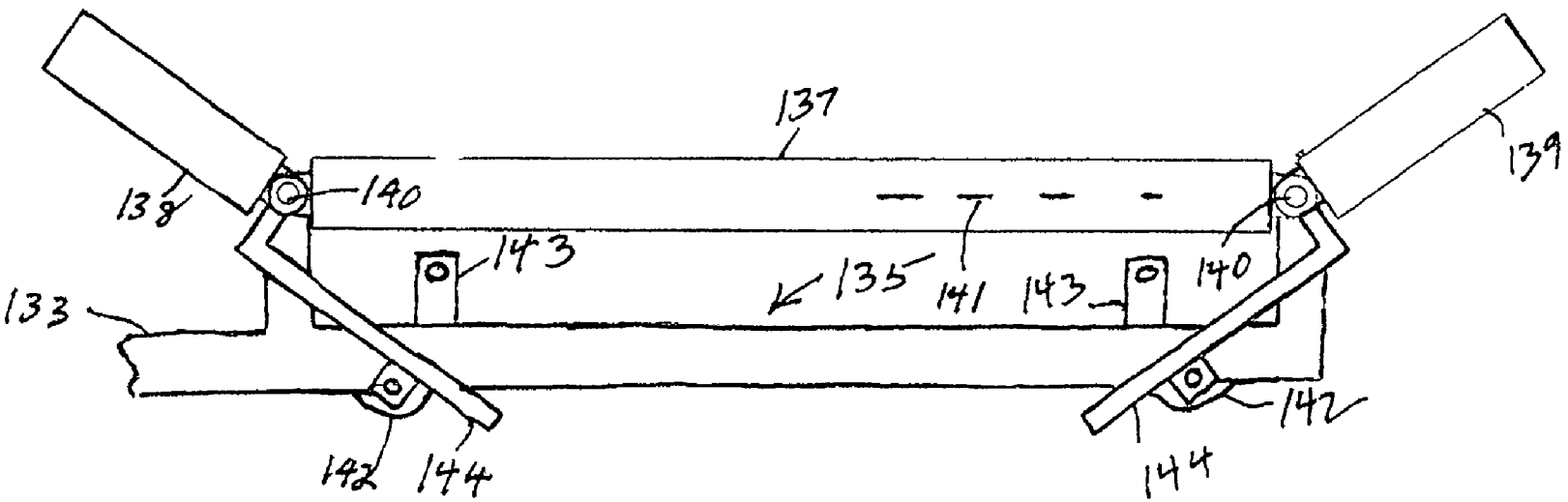
FIG. 14 is a side view of the belt lifting mechanism taken along line 14-14 in FIG. 1.
Figure 16:
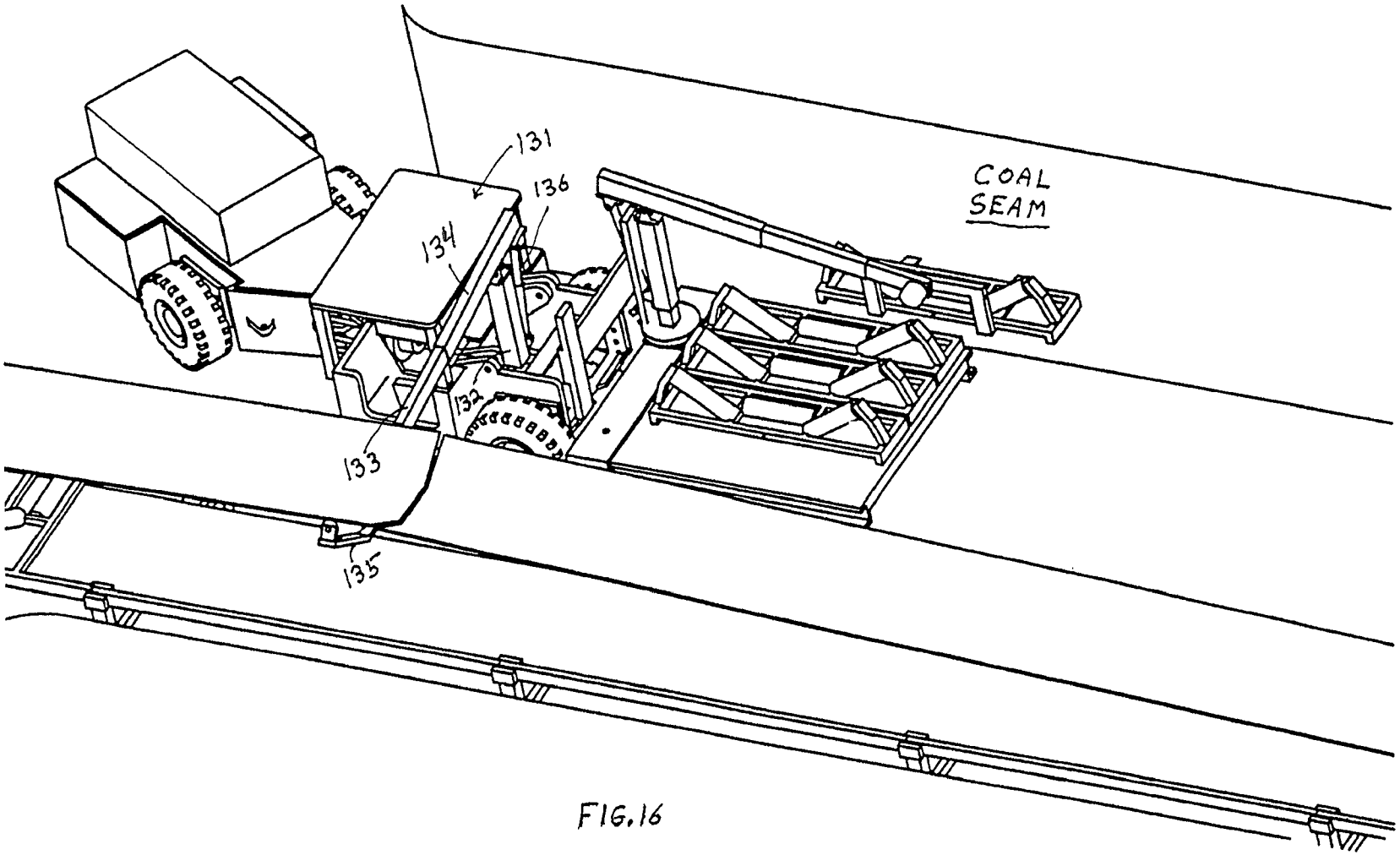
FIG. 16 is a perspective view showing the mining item placement crane and the belt lifting crane both in action.

Referring to FIGS. 14 and 16, the belt lifting crane generally designated 131, in a preferred embodiment is constructed the same as item lifting crane 19 as described above except that the lateral slide base mans 36, 38, 43, the item gripping means 66, and the articulating device 21 are not needed; however, a sliding bracket 131B may be provided, as shown in FIGS. 1-3. In that regard the end 133 of boom (or telescoping arms) 134 can be fixed to the belt lift frame 135 since only generally lateral extension and retraction of the boom sections and possibly vertical pivoting of the boom by hydraulic piston 136 is needed in order to move frame 135 underneath the belt and out from under the belt. Attached to frame 135 is a central roller 137 and side rollers 138, 139, the latter being mounted on frame 135 for up and down pivoting about pins 140 such that in the down positions they can lie on the rotational axis 141 of roller 137 for supporting a flat belt, and in the up position can accord to a conventional cradled belt. Arms 144 are fixed to the roller shaft body of 138 and 139 such as to give the up and down positions. Brackets 142 and 143 on frame 135 are provided with, e.g., bolt holes and bolts for retaining the arms in a selected one of the aforesaid positions. This element is shown in use in FIG. 1 wherein a conveyor belt (top side) 150 is lifted up away from the conveyor belt (return side) 151 by the belt lift frame assembly 135 hereinabove described, said frame extending from the boom of the lifting crane 131. In one embodiment side rollers 138 and 139 are about 9 inches long, the central roller 137 is about 34 inches long, the lateral distance between the lower portion of arms 144 is about 20 9/16 inches, and the distance between the top of the side rollers 138 and 139 and the bottom of the lower portion of arms 144 is about 14½ inches.

As shown in FIGS. 1-3, a fork lift 160 may further be incorporated between the base 34 and the vehicle so as to facilitate transportation of pallets of conveyor rails and the like.

The invention has been described in detail with particular reference to preferred embodiments thereof, but it will be understood that variations and modifications will be effected with the spirit and scope of the invention.

We claim:

1. A positioning apparatus for picking up heavy structural items and placing them in precise positions for assembly onto structures located in confined quarters, said apparatus comprising:

a support vehicle having a transport axis, base means having a first section adapted for attachment to said support vehicle, said base means having a second section mounted on said first section for movement bidirectionally with respect thereto, normal to said transport axis, and in a generally horizontal first plane, first power means for controllably moving said second section relative to said first section in said first plane, said base means having a third section mounted on said second section for bidirectional movement with respect thereto, normal to said transport axis, and in a generally horizontal second plane, by second power means, a first stanchion means mounted on a substantially vertical axis on said third section for movement with said third section, wherein said stanchion means is pivotally mounted on said third section for pivoting about said substantially vertical axis, third power means for pivoting said first stanchion means about said substantially vertical axis, a lifting boom having a longitudinal axis and an inner end portion pivotally mounted on an upper end portion of said first stanchion means for pivoting of said boom in a generally vertical plane, fourth power means for controllably pivoting said boom in said generally vertical plane, item gripping means mounted on an outer end of said boom by fifth power means for pivoting said gripping means into a desired posture relative to said boom, and wherein said boom is constructed with extendable-retractable sections for elongating or shortening said boom respectively, and wherein sixth power means is provided for extending and retracting said sections.

2. The apparatus of claim 1 where said first stanchion means is provided with a height adjustment structure and with seventh power means for lengthening the stanchion by means of said height adjustment structure.

3. The apparatus of claim 1 where said second section comprises an I-beam frame upon which said third section moves, and wherein the length of said third section is sized smaller than the length of said I-beam frame.

4. The apparatus of claim 1 where said boom is constructed with three separate but slidably associated sections.

5. The apparatus of claim 1 where said base means is attached to a front portion of said support vehicle and wherein a belt pick-up structure is mounted on said vehicle to the rear of said base means, wherein said pick-up structure comprises a second stanchion means mounted on said vehicle, a multi-sectional arm which is extendable and retractable by seventh power means is pivotally mounted on an upper portion of said second stanchion means for pivoting by eighth power means in a substantially vertical plane, wherein the extension and retraction of said arm is such that the outer end of said arm can be brought underneath the top run of a conveyor belt and the belt then lifted off of its top run rollers by upward pivoting of said arm.

6. The apparatus of claim 5 where said second stanchion means is pivotally mounted on said vehicle for rotation about a substantially vertical axis.

7. The apparatus of claim 1 where said fifth power means provides limited universal pivoting motion to said gripping means.

8. The apparatus of claim 1 where said gripping means comprises a face plate means which is provided on a bottom portion thereof with forwardly facing shelf means and which is further provided on an upper portion thereof with a power clamping device comprised of a sliding clamp powered by a hydraulic cylinder, said hydraulic cylinder causing said clamp to move parallel to said face plate means, thereby exerting a downward force perpendicularly toward said shelf means for clamping a said item between said device and said shelf means.

9. A lifting apparatus for assisting in installing heavy mining conveyor belt roller assemblies on or removing from a frame of a belt conveyor, which apparatus is mounted on a vehicle employed in mining operations, the vehicle having a transport axis, wherein the apparatus comprises:

a first stanchion means, a first lifting boom attached at a first end to said first stanchion means, and item gripping means attached at a second end of said first lifting boom; and a second lifting boom having an inner end pivotally attached to a second stanchion for pivotal motion in a substantially vertical plane by pivoting means and having an outer end affixed to a pick-up device adapted for grasping a portion of a said roller assembly, said second stanchion being pivotally mounted on a base member for rotation about a substantially vertical axis, wherein said base member is mounted on said vehicle by base means, for lateral movement thereon, said base means comprising three sections, the first section being attached to the vehicle; the second section being movably mounted on said first section, and the third section being movably mounted on said second section, wherein the second and third sections each move in respective horizontal planes, normal to the vehicle's transport axis, and wherein said second lifting boom is provided with telescoping structure for allowing the boom to be extended or retracted.

10. The apparatus of claim 1, wherein said first base section comprises at least one channel, and wherein said second base section comprises a strip and at least one longitudinally extending slide bar moveably held in place in the channel by said strip.

11. The apparatus of claim 10, wherein said second base section comprises at least one channel, and said third base section comprises a strip and at least one longitudinally extending slide bar moveably held in place in the channel by said strip.

12. The apparatus of claim 10, wherein said slide bars are manufactured from a material selected from the group consisting of: polytetrafluoroethylene, polyoxymethylene and high density polyurethane.

13. The apparatus of claim 1, wherein said second and third base sections each further comprise a support section, and a plurality of roller bearings along the exterior of the support section.

14. The apparatus of claim 1, wherein said first base section comprises at least one channel, with a plurality of roller bearings positioned within the channel.

15. The apparatus of claim 6, wherein the first stanchion means comprises a circularly grooved bottom having a ring of ball bearings.

16. The apparatus of claim 1 where said first stanchion means is provided with a height adjustment structure and with seventh power means for lengthening the stanchion by means of said height adjustment structure, wherein where said second section comprises an I-beam frame upon which said third section moves, and wherein the length of said third section is sized smaller than the length of said I-beam frame.

17. The apparatus of claim 16, where said second stanchion means is pivotally mounted on said vehicle for rotation about a substantially vertical axis.

18. The apparatus of claim 16, where said gripping means comprises a face plate means which is provided on a bottom portion thereof with forwardly facing shelf means and which is further provided on an upper portion thereof with a power clamping device comprised of a sliding clamp powered by a hydraulic cylinder, said hydraulic cylinder causing said clamp to move parallel to said face plate means, thereby exerting a downward force perpendicularly toward said shelf means for clamping a said item between said device and said shelf means.

* * * * *